US011111041B2

(12) United States Patent
Hoffmann

(10) Patent No.: US 11,111,041 B2
(45) Date of Patent: Sep. 7, 2021

(54) TUBE HOLDER FOR A TUBE FILLING MACHINE

(71) Applicant: IWK Verpackungstechnik GmbH, Stutensee (DE)

(72) Inventor: Stefan Hoffmann, Forst (DE)

(73) Assignee: IWK Verpackungstechnik GmbH, Stutensee (DE)

( * ) Notice: Subject to any disclaimer, the term of this patent is extended or adjusted under 35 U.S.C. 154(b) by 43 days.

(21) Appl. No.: 16/750,746

(22) Filed: Jan. 23, 2020

(65) Prior Publication Data

US 2020/0239166 A1 Jul. 30, 2020

(30) Foreign Application Priority Data

Jan. 24, 2019 (DE) ..... 102019000473.6

(51) Int. Cl.

| | |
|---|---|
| ***B65B 43/54*** | (2006.01) |
| ***B65B 3/16*** | (2006.01) |
| ***B65B 35/16*** | (2006.01) |
| ***B65B 59/00*** | (2006.01) |

(52) U.S. Cl.

CPC ..... *B65B 43/54* (2013.01); *B65B 3/16* (2013.01); *B65B 35/16* (2013.01); *B65B 59/005* (2013.01)

(58) Field of Classification Search

CPC ..... B65B 43/54; B65B 35/16; B65B 59/005; B65B 3/16

See application file for complete search history.

(56) References Cited

U.S. PATENT DOCUMENTS

| | | | | |
|---|---|---|---|---|
| 3,147,018 A * | 9/1964 | Reichert | ..... | B65B 3/16 279/35 |
| 3,390,891 A | 7/1968 | Stichhan | | |
| 3,819,194 A * | 6/1974 | Grevich | ..... | B65B 3/16 279/23.1 |
| 4,957,581 A * | 9/1990 | Jahrig | ..... | B29B 13/025 156/309.9 |

(Continued)

FOREIGN PATENT DOCUMENTS

| | | |
|---|---|---|
| DE | 1275438 B | 8/1968 |
| DE | 102006055854 A1 | 5/2008 |

OTHER PUBLICATIONS

German Search Report corresponding to German Application No. 10 2019 000 473.6, dated Apr. 30, 2019 (7 pages).

*Primary Examiner* — Nicolas A Arnett

(74) *Attorney, Agent, or Firm* — Flynn Thiel, P.C.

(57) ABSTRACT

A tube holder has a housing having an upwardly opening tube receptacle into which a tube can be inserted. A plurality of clamping elements arranged in the tube receptacle can be brought to abut an outer wall of the tube and a clamping force acting radially on the inserted tube cab be applied by at least one spring element. The clamping elements are pivotably mounted in a pivot bearing about a horizontal axis. Further clamping element are below the first group of pivot elements arranged over the tube receptacle and are under the action of the spring element and/or at least one further spring element. The clamping surface of at least some clamping elements and/or at least some further clamping elements at least in sections has a convex contour, curved about a horizontal axis, in the direction of a longitudinal central axis of the tube receptacle.

16 Claims, 6 Drawing Sheets

(56) References Cited

U.S. PATENT DOCUMENTS

| | | | | |
|---|---|---|---|---|
| 4,958,667 | A * | 9/1990 | Rece | B65B 3/16 141/113 |
| 6,082,077 | A * | 7/2000 | Christ | B65B 43/52 198/408 |
| 8,210,546 | B2 | 7/2012 | Köhler | |
| 8,453,686 | B2 * | 6/2013 | Klaus | G01G 17/04 141/83 |
| 10,173,799 | B2 * | 1/2019 | Miller | B65B 3/16 |

* cited by examiner

TUBE HOLDER FOR A TUBE FILLING MACHINE

CROSS-REFERENCE TO RELATED APPLICATION

This claims priority from German Application No. 102019000473.6, filed Jan. 24, 2019, the disclosure of which is hereby incorporated by reference, in its entirety into this application.

FIELD OF THE INVENTION

The invention relates to a tube holder for a tube filling machine, comprising a housing which has an upwardly opening tube receptacle into which a tube can be inserted with its one end region, wherein a plurality of clamping elements are arranged in the tube receptacle, which can each be brought to abut with a clamping surface with an outer wall of the tube and by means of which under the action of at least one spring element a clamping force acting radially from outside onto the inserted tube can be applied, wherein the clamping elements are each pivotably mounted in a pivot bearing about a horizontally extending pivot axis and wherein the clamping elements are arranged distributed over the circumference of the tube receptacle and form a first group of clamping elements.

BACKGROUND AND SUMMARY OF THE INVENTION

A tube filling machine usually has a continuously circulating conveying device which carries a plurality of receptacles into which respectively one tube holder is inserted. A tube with its head or cap section can be inserted into each tube holder from above, wherein the tube together with the tube holder passes through the individual work stations of the tube filling machine. In some work stations, for example, in the filling station and in the closure station, it can be provided that the tube with its tube holder is raised from the receptacle and inserted into the respective work station. After the end of the work step, the tube with its tube holder is lowered into the receptacle again. In a removal station, the filled and closed tube is removed from the tube holder and transported away.

Tube holders are known in various configurations. In particular, a tube holder has a housing with an upwardly opening tube receptacle into which a tube, which preferably consists of plastic or metal, is inserted with its head or cap section. A plurality of clamping elements are arranged in the tube receptacle, which are distributed over the circumference of the tube wall and are each under the action of a spring element. Each clamping element is adjustable perpendicular to the longitudinal central axis of the tube receptacle and is acted upon by the spring element radially inwards in the direction of the longitudinal central axis of the tube receptacle. When a tube is introduced into the tube receptacle, the tube presses the clamping elements radially outwards contrary to the respective spring force. As a result of the reaction force, the clamping elements are pressed radially from outside against the outer wall of the tube, with the result that the tube is clamped firmly in the tube receptacle.

The designations "top" and "bottom" used here refer to the usual alignment of a tube holder with an upwardly opening tube receptacle into which the tube with its head or cap section can be inserted from above so that the tube projects from the tube holder with its end to be closed at the top. With such an alignment of the tube holder, the longitudinal central axis of the tube receptacle extends vertically. The designation "axially" used here relates to the vertical longitudinal central axis of the tube receptacle. A radial displacement of the clamping elements takes place perpendicularly thereto and thus substantially horizontally. However, the invention is not restricted to a corresponding alignment of the tube holder and/or the tube receptacle.

Known from DE 10 2006 055 854 A1 is a tube holder in which the clamping elements are each mounted pivotably in a pivot bearing about a horizontally extending pivot axis. In this way, a defined pivoting movement of the clamping elements is given. By means of the known tube holder, the tubes are held non-positively. When inserting the tubes into the tube holder, the clamping elements are urged contrary to the spring force, with the result that they exert a clamping force on the tube and thus an increased friction force. During withdrawal of the tube, the same is pulled out upwards from the tube holder, with the result that the clamping elements return back into their initial position as a result of the spring force.

In this case however, there is the disadvantage that a separate tube holder is required for each tube shape and size. Should the dimensional tolerances of the tube be too large, this can result in problems in the known tube holder since the tube-diameter range for which a good hold can be achieved is only a few tenths of a millimetre around the desired dimension of the tube diameter. For this reason, the construction of the known tube holder is technically very demanding. Even for sample tubes for which the designer dimensions the tube holder, the precise tolerances and dimensions are frequently not known with the result that it can occur that the finished tube holders must be reworked once again. This is time-consuming and costly.

A tube holder is known from DE 12 75 438 A in which upwardly freely projecting fingers and downwardly freely projecting fingers which are under the action of radially inwardly acting spring elements are arranged alternately over the circumference of the tube receptacle. As a result of the freely projecting fingers, no defined pivoting movement and in particular no defined pivot axis is provided for these with the result that no movements which are exactly the same of the clamping elements are given.

The invention is based on the object of providing a tube holder of the said type by means of which tubes of different diameter can be held safely and reliably.

This object is achieved according to the invention by a tube holder according to the claims.

In this case, it is provided that below the first group of clamping elements further clamping elements are arranged at an axial distance, which are arranged distributed over the circumference of the tube receptacle and form a second group of further clamping elements and which can each be brought to abut with a clamping surface of the outer wall of the tube and by means of which under the action of the spring element and/or at least one further spring element a clamping force acting radially from outside onto the inserted tube can be applied, wherein the clamping elements are each pivotably mounted in a pivot bearing about a horizontally extending pivot axis. In this case, the clamping surface of at least some clamping elements and/or at least some further clamping elements at least in sections has a convex contour, curved about a horizontal axis, in the direction of a longitudinal central axis L of the tube receptacle.

The clamping surface of the clamping element facing the tube has a convex curvature at least in sections, wherein the curvature preferably extends from its upper end to the lower end. As a result of the convex, curved contour of the clamping surface, on the one hand, the insertion of the tube is facilitated and, on the other hand, as a result of the pivoting of the clamping element, an automatic adaptation to the diameter of the tube to be received takes place.

In order to ensure a secure hold of the tube inside the tube holder, a plurality of clamping elements are arranged preferably distributed uniformly over the circumference of the tube receptacle and therefore over the circumference of the tube. It has proved appropriate to provide at least two clamping elements and in particular 4, 5 or 6 clamping elements for the tube holder.

Preferably the plurality of clamping elements should be arranged in the same axial position of the longitudinal central axis of the tube receptacle, i.e. they should have no offset in the direction of the longitudinal central axis of the tube receptacle. The clamping elements arranged distributed over the circumference of the tube receptacle form a first group of clamping elements. The clamping elements of the first group can each be acted upon by a dedicated spring element but in a preferred embodiment of the invention it is provided that all the clamping elements of the first group of clamping elements are acted upon by a common spring element, for example, an annular spring, which either acts directly on the clamping elements or acts indirectly on the clamping elements with interposition of at least one component.

According to the invention, further clamping elements are arranged below the first group of clamping elements at an axial distance. Preferably a plurality of further clamping elements should be arranged distributed over the circumference of the tube receptacle and therefore the tube, wherein preferably each upper clamping element is assigned a lower further clamping element.

The plurality of further clamping elements are preferably arranged in the same axial position of the longitudinal central axis of the tube receptacle and form a second group of further clamping elements.

The further clamping elements are under the action of the spring element and/or at least one further spring element. The spring element and the further spring element can each be an annular spring. For the further clamping elements, a dedicated spring element can be provided in each case, alternatively however it is also possible that all the further clamping elements of the second group of further clamping elements are assigned a common further spring element in particular in the form of an annular spring. However, it can also be provided that the first group of clamping elements and the second group of further clamping elements are assigned a single common spring element, in particular in the form of an annular spring. The common spring element can act directly on the first group of clamping elements and its action is applied indirectly to the second group of further clamping elements, alternatively however it is also possible that the common spring element acts directly on the second group of further clamping elements and that its action is applied indirectly to the first group of clamping elements. Alternatively it is possible that the common spring element acts neither directly on the first group of clamping elements nor indirectly on the second group of further clamping elements but acts on a transmission component from which the spring force is transferred to the first group of clamping elements and the second group of further clamping elements.

At least some and preferably all the clamping elements and also at least some and preferably all the further clamping elements are each pivotably mounted in a pivot bearing with a defined pivot axis. This ensures a defined pivoting movement of the clamping elements or the further clamping elements and therefore defined clamping force on the tube.

In a preferred embodiment of the invention, it is provided that the convex contour of the clamping surface is formed by a section of a circle evolvent relative to the pivot axis. In this embodiment, it can be achieved that the contact point of the clamping surface of the clamping element on the outer surface of the tube also has the same axial distance from the pivot axis for tubes of different diameter. In this way, defined clamping conditions are also achieved for tubes of different diameter.

In a further development of the invention, it can be provided that a trough-shaped depression is formed on the clamping surface. The trough-shaped depression preferably extends from the upper end of the clamping surface to its lower end and can be adapted to the contour of the outer surface of the tube to be firmly clamped. In particular, it can be provided that the trough-shaped depression at least in sections has a concave cross-section in the direction of the longitudinal axis of the tube receptacle and therefore in the direction of the tube, which in a preferred embodiment is configured as a circular-arc-shaped cross-section.

In a further development of the invention, it can be provided that the cross-section of the trough-shaped depression varies continuously at least in sections and preferably over its entire length. This makes it possible that even tubes of different diameter can be clamped not only in a punctuate manner but over a circumferential section or circular arc of the tube diameter.

If a tube having a relatively small tube diameter is inserted into the tube receptacle, the clamping element is only urged slightly radially outwards so that the tube comes to abut with this in a central or in particular lower region of the clamping surface. In this region of the clamping surface the trough-shaped depression is provided with a cross-section which corresponds to the outer contour of the tube in sections.

If a tube having a relatively large diameter is inserted into the tube receptacle, the clamping element is pivoted by a greater distance so that an upper region of the clamping surface of the clamping element comes to abut with the outer wall of the tube. In this region also, the cross-section of the trough-shaped depression is adapted to the outer contour of the tube to be received. Due to a continuous variation of the cross-section of the trough-shaped depression, it can be achieved that each tube is acted upon by the clamping element with the clamping force independently of its diameter or its size over a circular arc of its cross-section.

In a further development of the invention it is provided that the force of the spring element and/or of the further spring element or of a common spring element acts on the clamping element or clamping elements at a distance a from the pivot axis, wherein a <=10 mm. Preferably it is provided that a <=8 mm and in particular a <=5 mm. Since the spring element preferably lies relatively close to the pivot axis of the clamping element, the change in the spring force during pivoting of the clamping element is relatively small. In this way, it can be achieved that the clamping forces by means of which tubes of different diameter can be firmly clamped in the tube receptacle only differ from one another by a small amount.

In a further development of the invention it is provided that adjacent clamping elements of the first group of clamping elements are each connected to one another. The clamping elements of the first group of clamping elements are therefore coupled with regard to their movement and in particular motion-synchronized.

The further clamping elements can be the same as the clamping elements located thereabove with regard to shape and/or with regard to constructive configuration, i.e. in particular can have a clamping surface which can be brought to abut with the outer wall of the tube, which at least in sections has a convex contour, curved about a horizontal axis, in the direction of the tube and preferably also has a trough-shaped depression with the aforesaid configuration.

In a preferred embodiment of the invention it is provided that at least one of the lower further clamping elements is connected via a connecting part to the clamping element located thereabove and in particular, is motion-synchronized with this clamping element. The connecting part can, for example, be a pendulum rod, i.e. a rod mounted in an articulated manner on both sides which is connected to the upper clamping element and to the lower further clamping element in an articulated manner. In this way, a four-bar linkage is formed with the pivot axes of the clamping elements by means of which a movement of the upper clamping element is transmitted to the lower further clamping element. Preferably each upper clamping element of the first group of clamping elements is connected to the associated further clamping element of the second group of clamping elements located thereunder, for which for example a plurality of connecting parts can be provided.

If a common spring element is provided for the first group of clamping elements and for the second group of further clamping elements, this can, for example, act on the connecting part or the connecting parts.

For the second group of further clamping elements it can also be provided that adjacent further clamping elements are each connected to one another and are thereby motion-synchronized.

In a particularly preferred embodiment of the invention, it is provided that the connecting part also connects adjacent upper clamping elements of the first group of clamping elements and/or adjacent lower further clamping elements of the second group of further clamping elements to one another. The connecting part is preferably configured to be H-shaped, wherein an upper clamping element is arranged between the two upper legs of the H shape and in particular can be pivotably mounted and wherein a lower further clamping element can be arranged between the two lower vertical legs and in particular pivotably mounted. The horizontal leg of the H shape preferably protrudes in opposite directions and in each case engages with a corresponding horizontal leg of an adjacent connecting part having an H shape. In this way, the H-shaped connecting part connects two clamping elements located one above the other to one another and engages with the adjacent H-shaped connecting parts via the horizontal legs.

BRIEF DESCRIPTION OF THE DRAWINGS

Further details and features of the invention are apparent from the following description of an exemplary embodiment with reference to the drawing. In the figures.

DETAILED DESCRIPTION OF THE DRAWINGS

Figure 1:
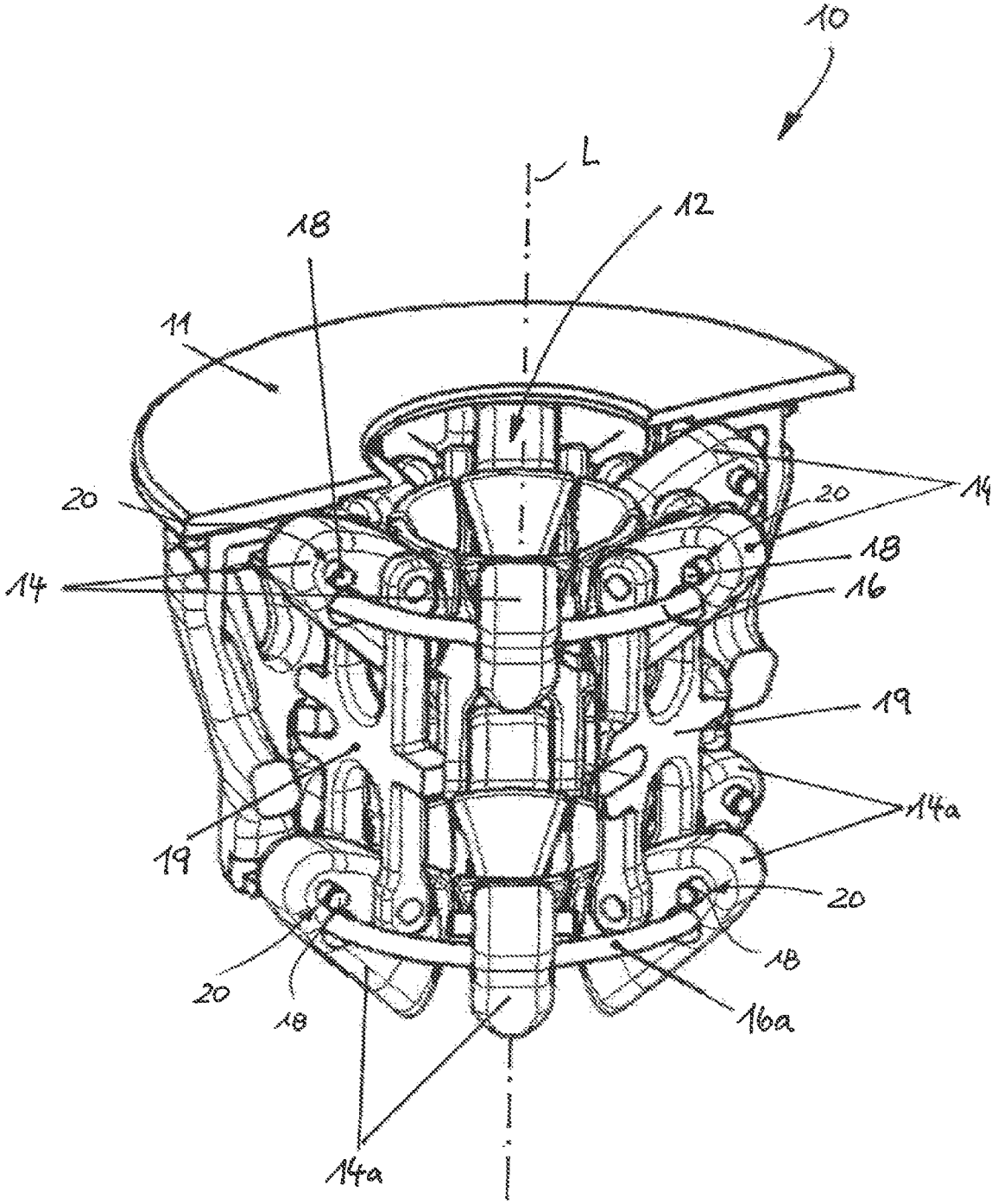
FIG. 1 shows a perspective view of a tube holder according to the invention.
Figure 2:
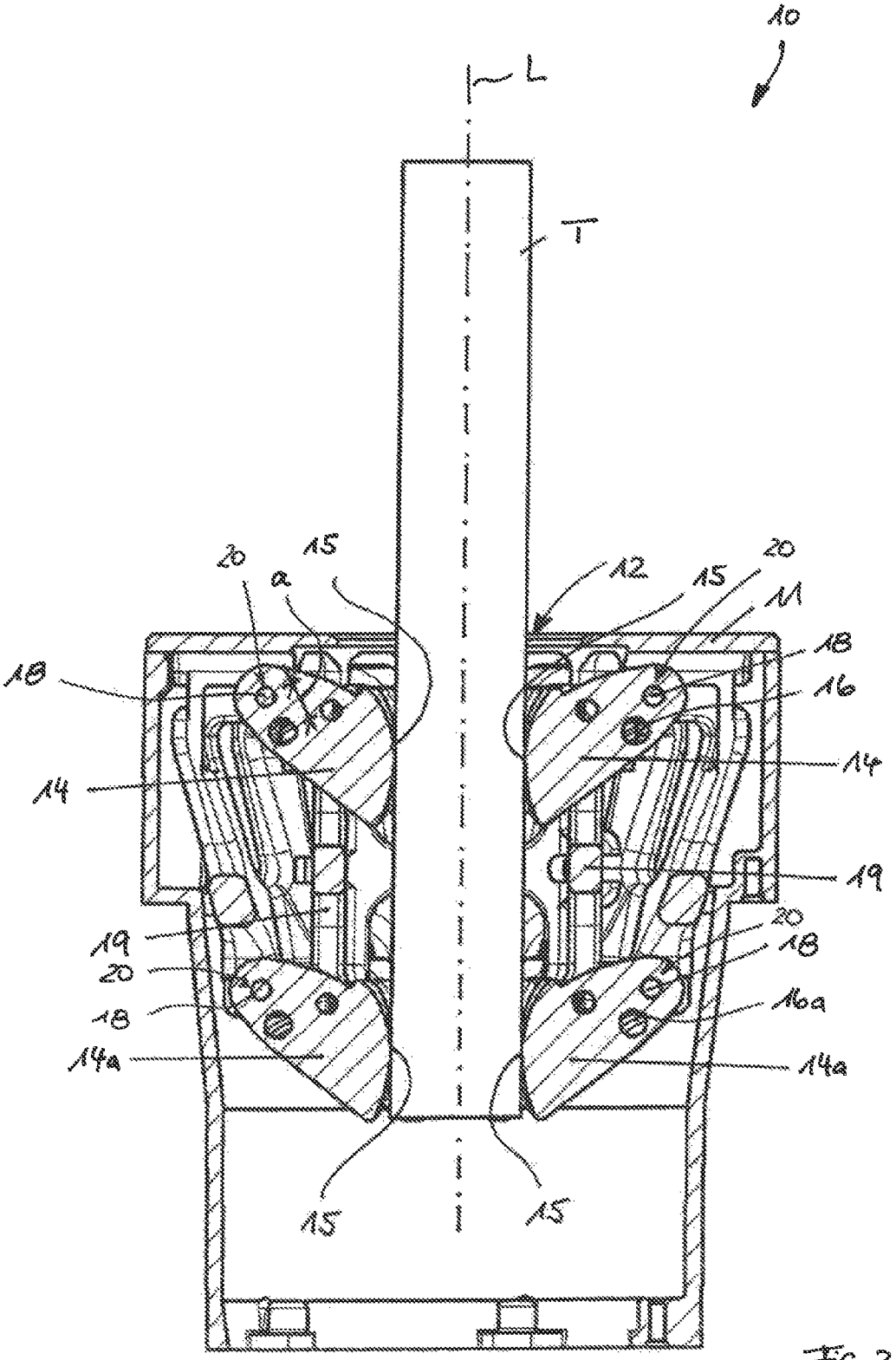
FIG. 2 shows a longitudinal section through the tube holder according to FIG. 1 with an inserted tube of relatively small diameter.
Figure 3:
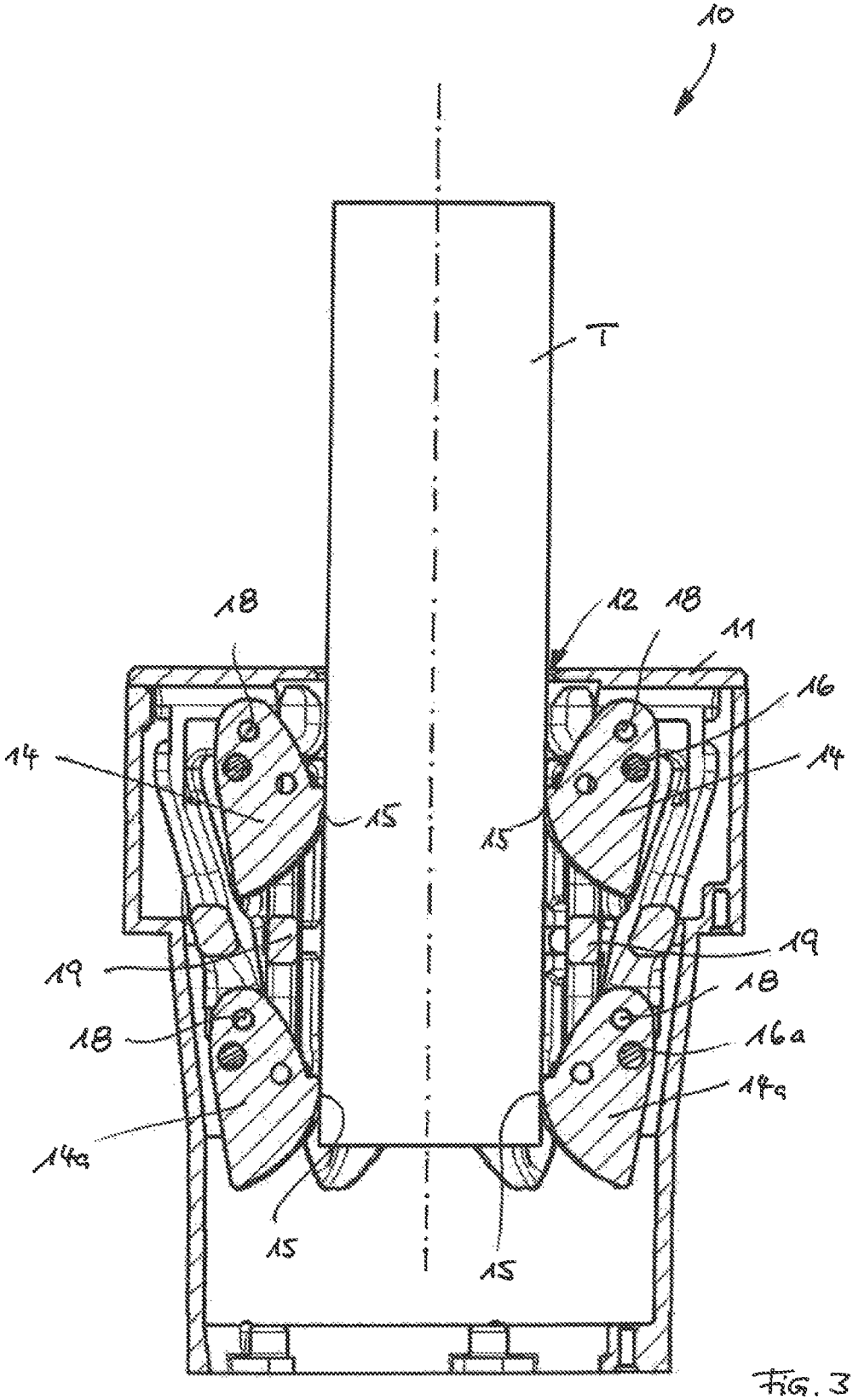
FIG. 3 shows a longitudinal section through the tube holder according to FIG. 1 with an inserted tube of relatively large diameter.

According to FIG. 1, a tube holder 10 has a housing 11 which preferably consists of plastic and in its interior has an upwardly open tube receptacle 12 which is adapted to the shape of a tube T to be received (see FIG. 2). A longitudinal central axis L of the tube receptacle 12 runs substantially vertically.

A first group of clamping elements 14 is arranged in the upper region of the tube receptacle 12, which clamping elements are distributed over the circumference of the tube receptacle 12 and are arranged at a common axial height of the longitudinal central axis L. Since the clamping elements 14, are all configured to be constructively the same, only one of the clamping elements 14 will be explained hereinafter. The same then applies to the other clamping elements 14.

The clamping element 14 is mounted pivotably in the housing 11 in a pivot bearing 20 about a horizontal pivot axis 18. All the clamping elements 14 are pre-tensioned in the direction of the longitudinal central axis L by means of a common spring element 16 which is formed by an annular spring. The spring element 16 in this case acts on the clamping element 14 at a relatively short distance a of about 3 mm to 5 mm from the pivot axis 18 (see FIG. 2).

At an axial distance below the first group of pivot elements 14, there is arranged a second group of further pivot elements 14*a* of the same type which corresponds to the first group of pivot elements 14 in the constructive respect and comprises a plurality of further pivot elements 14*a* of the same type which are arranged distributed over the circumference of the tube receptacle 12. The further pivot elements 14*a* are under the action of a further spring element 16*a*, which is also configured as an annular spring and acts upon the further pivot elements 14*a* in the direction of the longitudinal central axis L of the tube receptacle 12.

Each of the upper clamping elements 14 is connected to a lower further clamping element 14*a* located thereunder at an axial distance via a connecting part 19, which will be discussed subsequently in detail. All the further clamping elements 14*a* have the same constructive structure and correspond to the clamping elements 14 in terms of their constructive structure.

Figure 4:
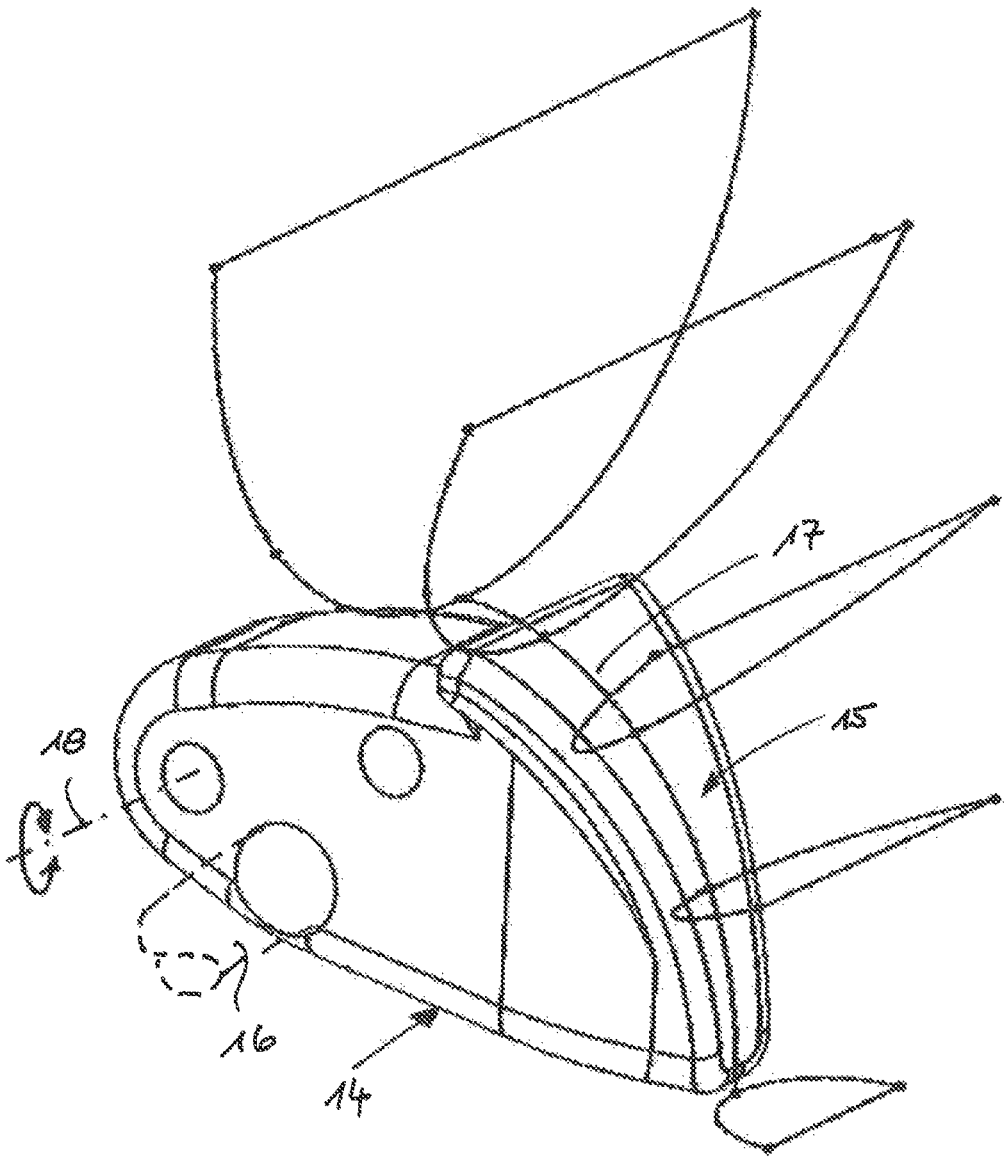
FIG. 4 shows a perspective view of a clamping element.

One of the clamping elements 14 is shown in FIG. 4 and will be explained in the following. These explanations apply accordingly for the further clamping elements 14*a*. The clamping element 14 is configured to be block-shaped and is pivotable about the horizontal pivot axis 18, as is indicated by the double arrow S. The clamping element 14 is pierced by the spring element 16 and on its side facing the longitudinal central axis L of the tube receptacle 12 has a clamping surface 15 which can be brought to abut with an outer wall of the tube T. The clamping surface 15 has a convex contour, curved about a horizontal axis, in the direction of the longitudinal central axis L. The convex contour of the clamping surface 15 can be formed by a section of a circle evolvent relative to the pivot axis 18.

A trough-shaped depression 17 is formed on the clamping surface 15, extends in the vertical longitudinal direction of the clamping surface 15 and has a concave cross-section in the direction of the longitudinal central axis L and in particular a circular-arc-shaped cross-section.

The cross-section of the trough-shaped depression 17 is smaller at the lower end of the clamping surface 15 than at its upper end and varies continuously in the longitudinal direction of the clamping surface 15. FIG. 4 shows schematically several semicircles which each symbolize the cross-section of tubes of different diameter. As a result of the continuously varying, circular-arc-shaped cross-section of the depression 17, the clamping surface can abut against tubes of different diameter over a large area.

Figure 5:
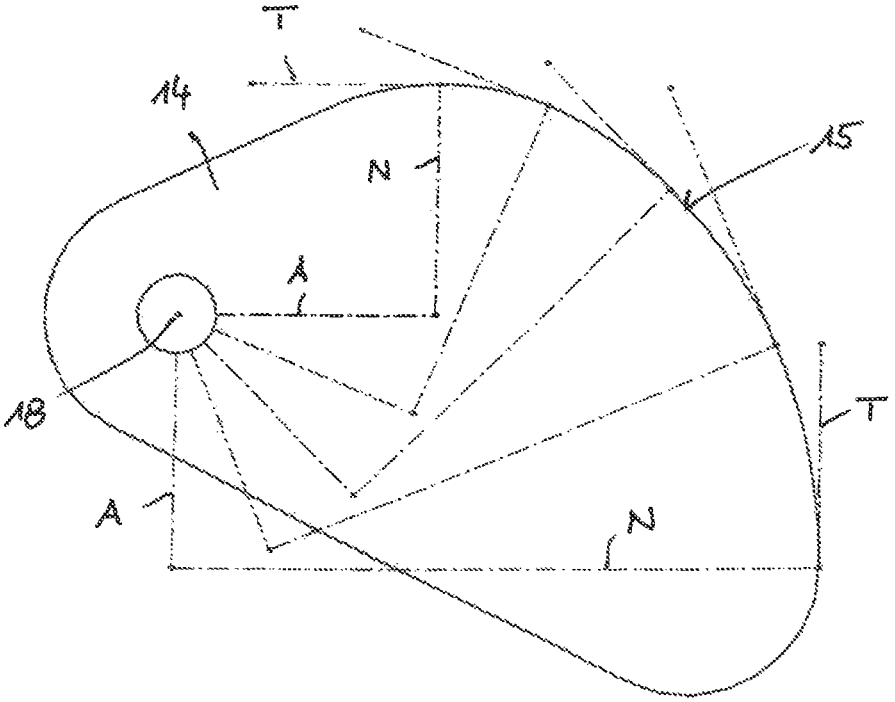
FIG. 5 shows a schematic side view of the clamping element.

Preferably the convex contour of the clamping surface is formed by a section of a circle evolvent relative to the pivot axis 18, as shown symbolically in FIG. 5. This has the result that for each point of the circle evolvent, a normal N to a tangent T running through the point runs at the same distance A from the pivot axis 18. This has the result that the clamping point at which the clamping surface 15 (mathematically theoretically) comes to abut with the outer surface of the tube T has the same distance from the pivot axis 18 regardless of the diameter of the tube T.

Figure 6:
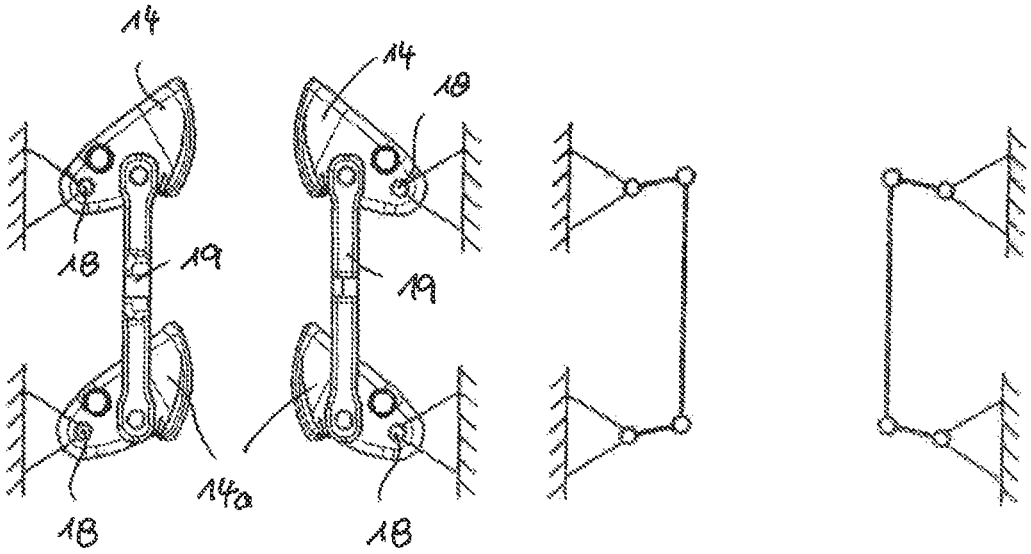
FIG. 6 shows the coupling of clamping elements arranged one above the other in side view together with the basic kinematic structure.

As shown in FIG. 6, in each case one of the clamping elements 14 and the associated further clamping elements 14*a* arranged thereunder are connected to one another via a connecting part 19 and motion-synchronized, i.e. when the upper clamping element 14 pivots by an angle α, this pivoting movement is transmitted via the connecting part 19 to the lower further clamping element 14*a* which pivots about a corresponding angle α. The connecting part 19 is mounted in an articulated manner both at the upper clamping element 14 and also at the lower further clamping element 14*a* so that from a kinematic viewpoint a four-bar linkage is formed, as shown schematically on the right side of FIG. 6.

Figure 7:
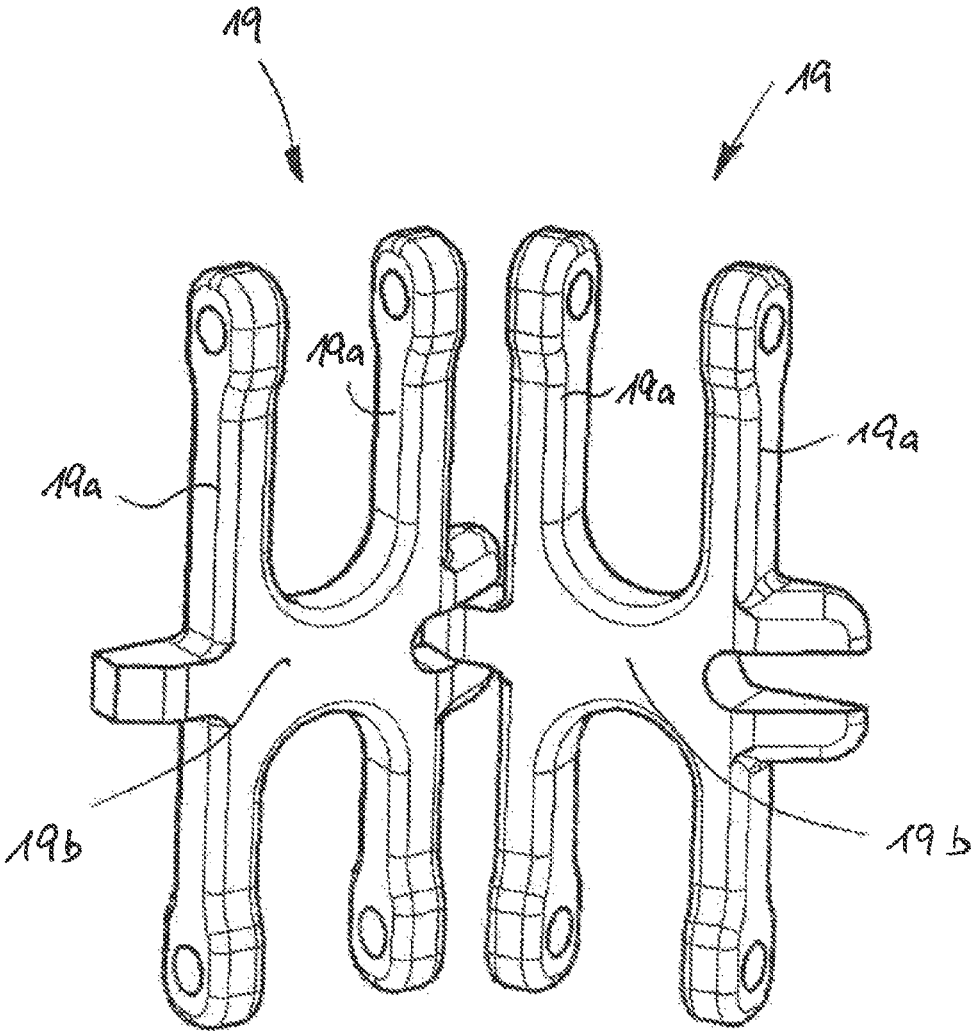
FIG. 7 shows a perspective view of two connecting parts in engagement with one another.

The connecting part 19 is shown in FIG. 7. The connecting part 19 has an H-shaped configuration with two vertical legs 19*a* located at a distance next to one another. Between the upwardly pointing sections of the legs 19*a* of the connecting part 19, respectively one of the clamping elements 14 is mounted in an articulated manner and between the downwardly pointing sections of the legs 19*a* respectively one of the lower further clamping elements 14*a* is mounted in an articulated manner.

Each connecting part 19 has a horizontal central leg 19*b* with horizontal projections protruding on opposite sides via which adjacent connecting parts 19 are in engagement with one another. One of the projections is configured as a fork (see FIG. 7, right side) while the projection formed on the opposite side is configured as an engaging part which can be inserted in the fork. By means of the connecting parts 19 it is achieved that both the clamping elements 14 of the upper first group of clamping elements 14 and also the lower further clamping elements 14*a* of the lower second group of clamping elements 14*a* are motion-synchronized with one another.

I claim:

1. Tube holder for a tube filling machine, comprising a housing which has an upwardly opening tube receptacle into which one end region of a tube can be inserted, wherein first clamping elements are arranged in the tube receptacle, which can each be brought to abut with a first clamping surface to an outer wall of the tube and by which under the action of at least one first spring element a first clamping force acting radially from outside onto the inserted tube can be applied, wherein the first clamping elements are arranged and distributed over the circumference of the tube receptacle and form a first group of the first clamping elements, wherein below the first group of the first clamping elements second clamping elements are arranged at an axial distance, which are arranged and distributed over the circumference of the tube receptacle and form a second group of the second clamping elements and which can each be brought to abut with a second clamping surface to the outer wall of the tube and by which under the action of the at least one first spring element and/or at least one second spring element a second clamping force acting radially from outside onto the inserted tube can be applied, wherein the first and second clamping elements are each pivotably mounted in a pivot bearing about a horizontally extending pivot axis, wherein the first clamping surface of a plurality of the first clamping elements and/or a second clamping surface of a plurality of the second clamping elements at least in sections has a convex contour, curved about a horizontal axis, in the direction of a longitudinal central axis of the tube receptacle.

2. Tube holder according to claim 1, wherein the convex contour is formed by a section of a circle evolvent relative to the horizontally extending pivot axis.

3. Tube holder according to claim 1, wherein a trough-shaped depression is formed on each of the first and second clamping surfaces.

4. Tube holder according to claim 3, wherein the trough-shaped depression at least in sections has a concave cross-section in the direction of the longitudinal central axis of the tube receptacle.

5. Tube holder according to claim 3, wherein the trough-shaped depression at least in sections has a circular-arc-shaped cross-section in the direction of the longitudinal central axis L of the tube receptacle.

6. Tube holder according to claim 3, wherein the cross-section of the depression varies continuously at least in sections.

7. Tube holder according to claim 1, wherein the force of the at least one first spring element and/or of the at least one second spring element acts on a related one of the first and second clamping elements at a distance a from the pivot axis, wherein a ≤10 mm.

8. Tube holder according to claim 1, wherein the first group of the first clamping elements are arranged in the same axial position of the longitudinal central axis of the tube receptacle.

9. Tube holder according to claim 1, wherein adjacent clamping elements of the first group of the first clamping elements are each connected to one another.

10. Tube holder according to claim 1, wherein the first clamping elements of the first group of the first clamping elements are motion-synchronized.

11. Tube holder according to claim 1, wherein at least one of the second clamping elements is connected via a connecting part to one of the first clamping elements located thereabove.

12. Tube holder according to claim 10, wherein the at least one of the second clamping elements is motion-synchronized with the one of the first clamping elements arranged thereabove.

13. Tube holder according to claim 11, wherein the first clamping elements of the first group of the first clamping elements and/or the second clamping elements of the second group of the second clamping elements are motion-synchronized by the connecting part.

14. Tube holder according to claim 1, wherein the second clamping elements are arranged in the same axial position of the longitudinal central axis of the tube receptacle.

15. Tube holder according to claim 1, wherein adjacent second clamping elements of the second group of the second clamping elements are connected to one another.

16. Tube holder according to claim 15, wherein the second clamping elements of the second group of the second clamping elements are motion-synchronized.

* * * * *